US006544066B2

(12) United States Patent
Fukase

(10) Patent No.: US 6,544,066 B2
(45) Date of Patent: Apr. 8, 2003

(54) CONNECTOR

(75) Inventor: Yoshihiro Fukase, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/899,087

(22) Filed: Jul. 6, 2001

(65) Prior Publication Data

US 2002/0004333 A1 Jan. 10, 2002

(30) Foreign Application Priority Data

Jul. 7, 2000 (JP) ..... 2000-207435

(51) Int. Cl.[7] ..... H01R 13/627
(52) U.S. Cl. ..... 439/352; 439/489
(58) Field of Search ..... 439/310, 350, 439/352, 353, 488, 489

(56) References Cited

U.S. PATENT DOCUMENTS 5,628,648 A * 5/1997 Higgins, Jr. et al. ..... 439/489
5,848,912 A * 12/1998 Okabe ..... 439/489
6,358,081 B1 * 3/2002 Saka et al. ..... 439/352

FOREIGN PATENT DOCUMENTS

DE 197 14 459 A1 10/1998
JP 10-50408 2/1998 ..... H01R/13/639

* cited by examiner

*Primary Examiner*—Khiem Nguyen
(74) *Attorney, Agent, or Firm*—Sughrue Mion, PLLC

(57) ABSTRACT

A connector 29 comprises a male connector 31, a female connector 33 to be fitted to this male connector 31, an elastic latching member 43, which is provided on an outer periphery of one of the male connector 31 and the female connector 33 and engages with the other connector to retain a fitted state of the connectors 31 and 33, and a half-fitting prevention member 35 for notifying a half-fitted state by detaching the male connector 31 and the female connector 33 when the connectors 31 and 33 are in a half-fitted state, and for preventing the half-fitted state from being retained. The half-fitting prevention member 35 is placed at a height that is nearly equal to or less than a height of the elastic latching member 43, which projects from an outer peripheral surface 51, thereabove.

7 Claims, 13 Drawing Sheets

CONNECTOR

BACKGROUND OF THE INVENTION

1. Technical Field of the Invention

The present invention relates to a connector for preventing a half-fitted state, in which a male housing and a female housing are half-fitted to each other.

2. Related Art

In the case that when a female connector is connected to a male connector, such a connecting operation is finished in a state in which the connectors are half-fitted to each other, the connectors may be detached from each other after the operation. Thus, a half-fitting prevention member is provided in the connector to thereby prevent an occurrence of a half-fitted state. Consequently, reliable fitting of female and male connectors is achieved.

One such connector is proposed and described in JP-A-10-50408. As illustrated in FIG. 27, a connector 1 comprises a male connector 3, a female connector 5 into which the male connector 3 is fitted, and a half-fitting prevention member 7 for preventing an occurrence of a half-fitted state of the male connector 3 and the female connector 5.

The male connector 3 has an exclusive-use housing 11 that is formed in such a manner as to be integral with an outer wall of a male housing body 9 and that is disposed at an upper portion thereof. A flexible arm 13 for retaining a state, in which the male connector 3 is fitted into the female connector 5, is provided in the exclusive-use housing 11. The flexible arm 13 has a pressure release portion 15 provided on the top surface thereof and an engaging projection 17 provided on the bottom surface of a leading end portion thereof.

The female connector 5, to which the male connector 3 is fitted, has pressing portions 19 provided on the outer peripheral surface thereof in such a way as to protrude therefrom, and also has an engaging portion 21 to be engaged with the engaging projection 17 of the flexible arm 13 in a state in which the male connector 3 is fitted into the female connector 5. Further, the half-fitting prevention member for preventing an occurrence of a half-fitted state, in which the male connector 3 is half-fitted to the female connector 5, is incorporated into the male connector 3.

The half-fitting prevention member 7 is constituted by an elastic member 23, which is held in the exclusive-use housing 11, and a slider 25 that is supported by this elastic member 23 and disposed on the flexible arm 13 and held in the exclusive-use housing 11.

When the male connector 3 is fitted into the female connector 5 in the connector 1 of such a configuration, first, the male connector 3 is inserted into the female connector 5. At that time, the slider 25 is pushed by the pressing portion 19 against a pushing force of the elastic member. Thus, the slider 25 is moved on the flexible arm 13 in a fitting direction.

Then, in the case that the male connector 3 and the female connector 5 are brought into a fitted state by inserting the male connector 5 into a completely inserted position in the female connector 5 in which an outer wall 2 of the female connector 5 is positioned under the exclusive-use housing 11, the engaging projection 17 provided on the bottom surface of the flexible arm 13 is engaged with the engaging portion 21 of the outer wall 27 of the female connector 5, so that the fitting between the male connector 3 and the female connector 5 is put into a temporarily held condition. At that time, the pushing state of the pressing portion 19 is canceled by the pressure release portion 15, so that the slider 25 is moved by the pushing force of the elastic member 23 to an initial position thereof. Further, the slider 25 is engaged with an upper-side part of the leading end portion of the flexible arm 13. This prevents accidental displacement of the flexible arm 13. Consequently, the fitting state, in which the male connector 3 and the female connector 5 are fitted to each other, is retained.

However, the slider 25 and the exclusive-use housing 11 for holding the slider 25 are disposed over the flexible arm 13 in the related connector 1. Thus, the dimension in the direction of width or height of the male connector is large. Consequently, the related connector has encountered the problem that the size of the entire connector is large.

Conversely, in the case that the slider 25 is placed under the flexible arm 13, the slider 25 cannot be engaged with the upper part of the leading end portion of the flexible arm 13 during the connector is in the state in which the male connector 3 and the female connector are temporarily fitted to each other. Thus, when the flexible arm 13, whose engaging projection 17 is engaged with the engaging portion 21, happens to undergo upward displacement, there is a fear that the fitting state, in which the male connector 3 and the female connector 5 are fitted to each other, cannot be reliably retained.

SUMMARY OF THE INVENTION

Accordingly, an object of the invention is to provide a connector enabled to reduce the size of the entirety thereof without increasing the dimensions in the directions of width and height thereof and to retain the fitting state of the male and female connectors.

To achieve the foregoing object, according to the invention, there is provided a connector (hereunder referred to as a first connector) that comprises a male connector, a female connector into which this male connector, an elastic latching member, which is provided on an outer periphery of one of the male and female connectors, for retaining a fitted-state of the male and female connectors, and a half-fitting prevention member for detaching, when the male connector and the female connector are half-fitted to each other, the connectors from each other to thereby notify a half-fitted state, in which the male and female connectors are half-fitted to each other, and prevent the half-fitted state from being retained. Thus, the half-fitting prevention member is placed at a height that is nearly equal to or less than a height of the elastic latching member above a surface of the outer periphery, which projects therefrom, without increasing the dimensions in the direction of width and height of one of the male and female connectors.

In the connector of such a configuration, in a state in which the male and female connectors are fitted to each other, the elastic latching portion retains the fitted state of the male and female connectors. At that time, in the case that the male and female connectors are in a half-fitted state in which the connectors are not completely fitted to each other, the half-fitting prevention member detaches the male connector from the female connector and notifies that the connectors are half-fitted to each other. This prevents the half-fitted state of the connectors from being retained.

Further, in this connector, the male and female connectors can retain a fitted state thereof. Thus, the half-fitting prevention member can be disposed at a height that is nearly equal to or less than a height of the elastic latching member placed above a surface of the outer periphery, which is projects therefrom, without increasing the dimensions in the directions of width and height of one of the male and female connectors.

An embodiment (hereunder referred to as a second connector) of the first connector of the invention comprises a fitting hood portion, which is provided at the other of the male and female connectors and put into a fitted state by having the one of the male and female connectors inserted, and a latching hood portion that is provided in this fitting hood portion and has the elastic latching portion caught in the fitted state, in which the male and female connectors are fitted to each other, and that accommodates the entire elastic latching portion, in addition to the constituent elements of the first connector.

In the second connector configured in this manner, the one of the male and female connectors is inserted into the fitting hood portion of the other of the connectors. In this condition, when the connector is brought into a fitted state by inserting the one of the male and female connectors to a regular insertion position in the other of the male and female connectors, the elastic latching portion is caught in the latching hood portion. Moreover, the latching hood portion accommodates the entire elastic latching portion to thereby prevent the elastic latching portion from being accidentally bent by an external force.

In an embodiment (hereunder referred to as a third connector) of the first or second connector of the invention, the half-fitting prevention member comprises an elastic member connected to the one of the male and female connectors, and a slider that is supported in such a manner as to be able to move in a fitting direction and that is pushed against a pushing force by the other of the male and female connectors when the male connector is fitted into the female connector.

In the third connector configured in this manner, when the male and female connectors are put into a fitted state, the slider is pushed against the pushing force of the elastic member by the other of the male and female connectors. Thus, when the connectors are in a half-fitted state, the slider pushes the other of the connectors and detaches from the male connector from the female connector by the pushing force of the elastic member to thereby notify the half-fitted state of the connectors.

In an embodiment (hereunder referred to as a fourth connector) of the third connector of the invention, the elastic latching portion comprises arm portions, each of which has an end part connected to an outer peripheral surface of one of the male and female connectors, and a bending portion for bending the arm portions between the one of the end parts and the other thereof to thereby have elasticity and for placing an other-end-side part of the arm portion along the outer peripheral surface, and latching projections each provided on an outer surface of the other-end-side part of the arm portion. The fourth connector further comprises a resilient member disposed along the outer peripheral surface of the one of the connectors, a slider provided in such a way as to be laid across the resilient member, and an operation portion, which is formed in the slider so that the resilient member is disposed between an inner surface thereof and the outer peripheral surface, to be operated when the fitted state of the male and female connectors is canceled. The operation is formed so that a height of an end surface of each of the latching projections above the outer peripheral portion is almost equal to a height of an end surface of the operation portion thereabove.

In the fourth connector configured in this manner, the latching projection of each of the arm portions in the fitted state of the male and female connectors is caught in the latching hood portion by the pushing force of the bending portion, so that the fitted state of the male and female connectors is retained. Thus, the resilient member is disposed along the outer peripheral surface, and the slider is provided in such away as to be laid across the resilient member without increasing the dimensions in the directions of width and height thereof and to retain the fitting state of the male and female connectors. Further, the operation portion is formed in the slider so that the resilient member is placed between the inner surface thereof and the outer peripheral surface of one of the male and female connectors. The operation portion and the latching projections are formed so that the height of an end surface of the operation portion is nearly equal to the height of an end surface of each of the latching projections.

An embodiment (hereunder referred to as a fifth connector) of the third or fourth connector of the invention has a retainment canceling portion for canceling the retainment of the fitted state, which is performed by the elastic latching portion, when the slider in the fitted state of the male and female connectors is moved against the pushing force of the resilient force.

In the fifth connector configured in this manner, the retainment canceling portion can cancel the retainment of the fitted state of the male and female connectors by moving the slider in the fitted state against the pushing force of the resilient member of the slider.

In an embodiment (hereunder referred to as a sixth connector) of the fifth connector of the invention, the retainment canceling portion comprises a retainment canceling projection provided on a side end surface of the elastic latching portion in such a way as to protrude therefrom, slider arms provided in the slider and disposed on a side of the elastic latching portion in the fitted state of the male and female connectors, and slider projections, each of which is provided on this slider arm in such a way as to protrude therefrom and which abuts against the elastic latching portion and bends the elastic latching portion when the slider is moved against the pushing force of the resilient member in the fitted state.

In the sixth connector configured in this way, the slider is moved against the pushing force of the resilient member in the fitted state of the male and female connectors. At that time, the slider arm moves together with the slider so that the slider projection abuts against the canceling projection. In such a state, the slider is moved still more thereby to bend the elastic latching portion and to cancel the retainment of the fitted state of the male and female connectors.

An embodiment (hereunder referred to as a seventh connector) of one of the third to sixth connectors has an engaging portion for engaging the latching hood portion with the slider in the fitted state of the male and female connectors.

In the seventh connector configured in this way, the latching hood portion and the slider can be engaged with each other by the engaging portion in the fitted state of the male and female connectors.

DETAILED DESCRIPTION OF THE PREFERRED EMBODIMENT

Figure 1:
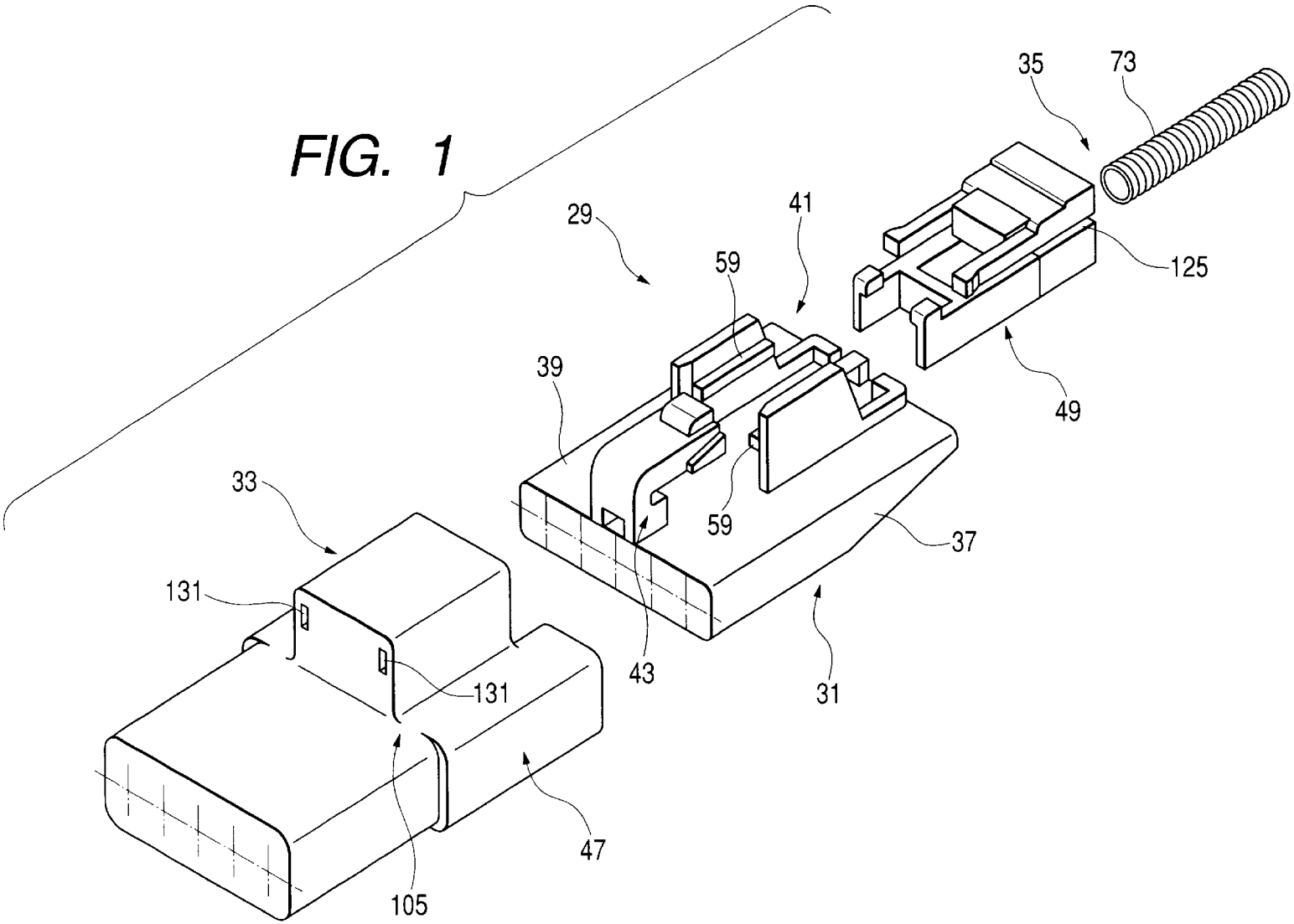
FIG. 1 is an exploded perspective view illustrating a first embodiment of the connector according to the invention.
Figure 2:
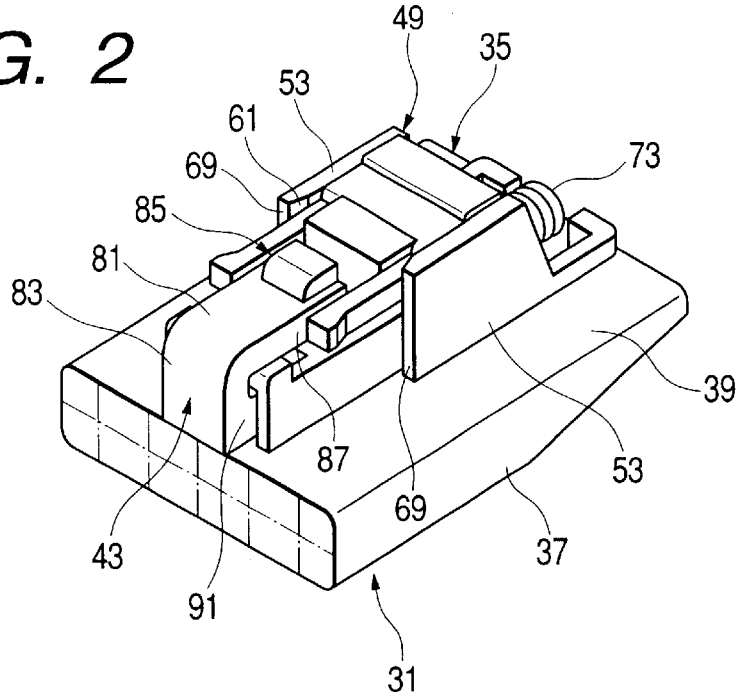
FIG. 2 is a perspective view illustrating a state in which a male connector and a half-fitting prevention member used in the first embodiment of the connector of the invention are assembled.
Figure 3:
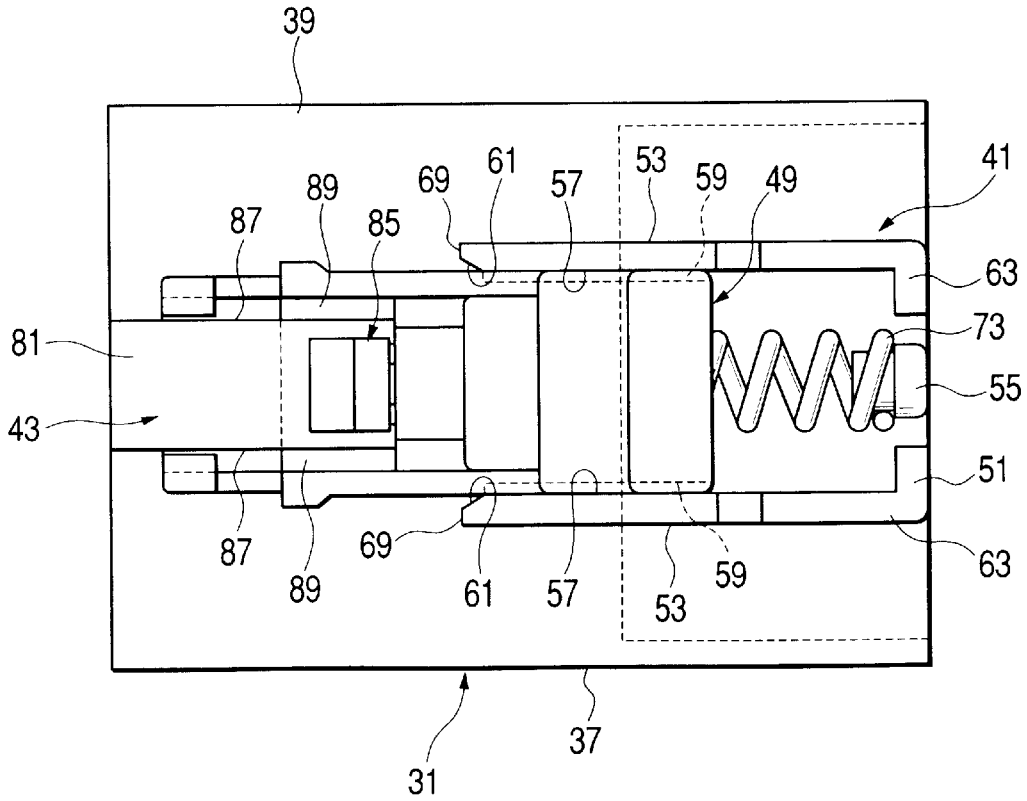
FIG. 3 is a plan view illustrating the male connector shown in FIG. 2.
Figure 4:
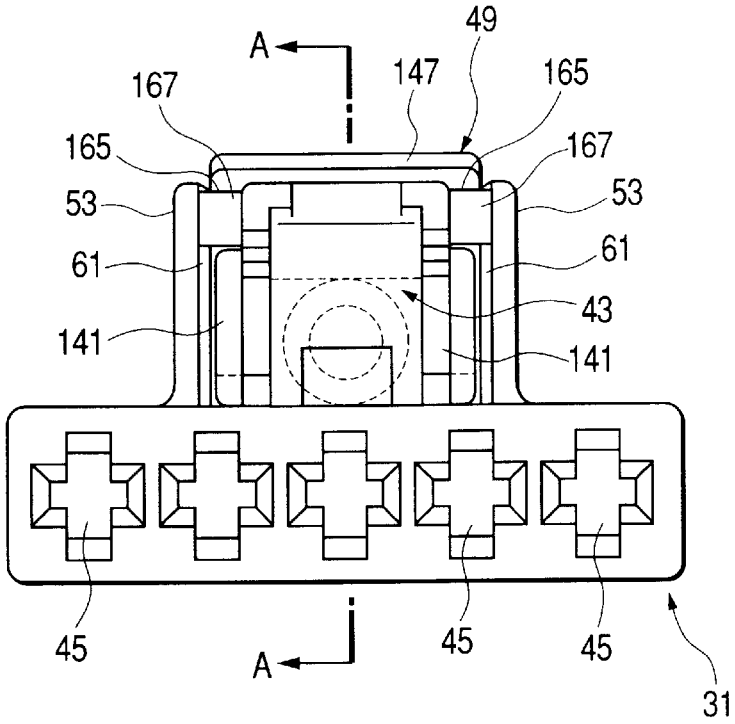
FIG. 4 is a front view illustrating the male connector shown in FIG. 2.
Figure 5:
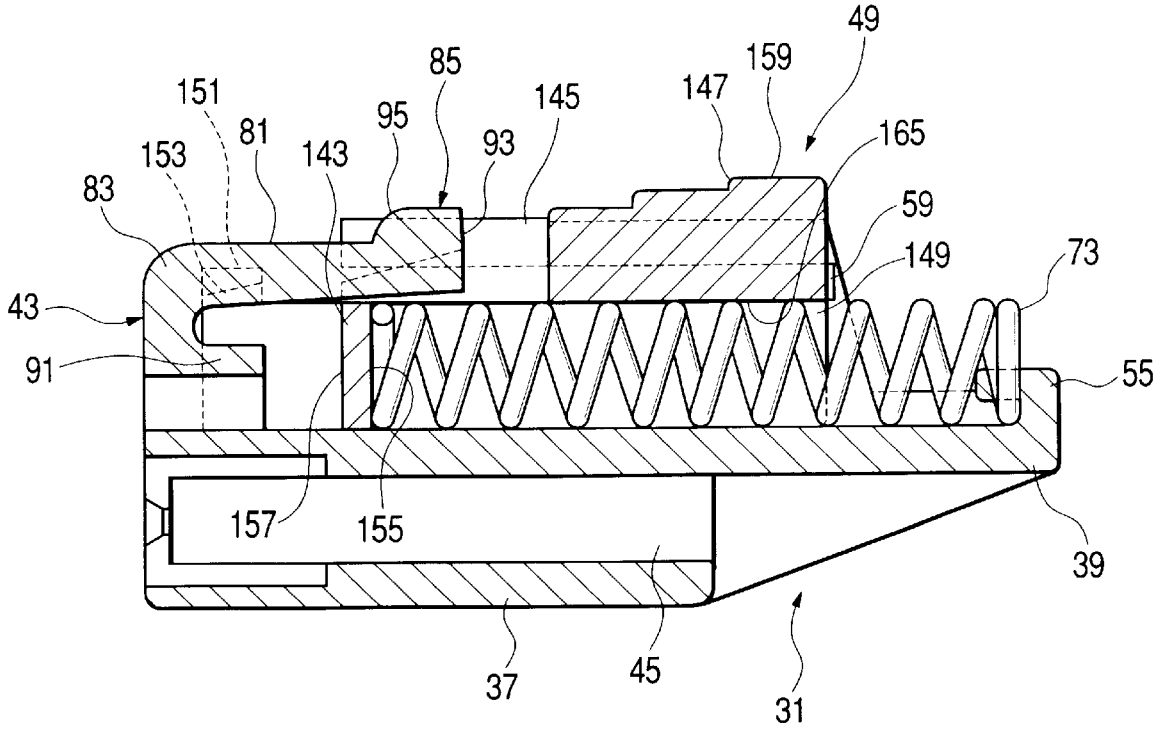
FIG. 5 is a sectional view taken on line A—A of FIG. 4 and illustrating the male connector shown in FIG. 4.

Hereinafter, an embodiment of the connector according to the invention is described. FIG. 1 is an exploded perspective view illustrating a first embodiment of the connector according to the invention. FIG. 2 is a perspective view illustrating a condition in which the male connector and the half-fitting prevention member are assembled. FIG. 3 is a plan view of the male connector shown in FIG. 2. FIG. 4 is a front view of the male connector shown in FIG. 2. Further, FIG. 5 is a sectional view of the male connector, which is taken on line A—A of FIG. 4.

As shown in FIGS. 1 to 5, the connector 29 comprises a male connector 31, a female connector 33 into which the male connector 31 is fitted, and a half-fitting prevention member 35, which is provided in the male connector 31, for preventing the half-fitted state of the male and female connectors 31 and 33.

Figure 6:
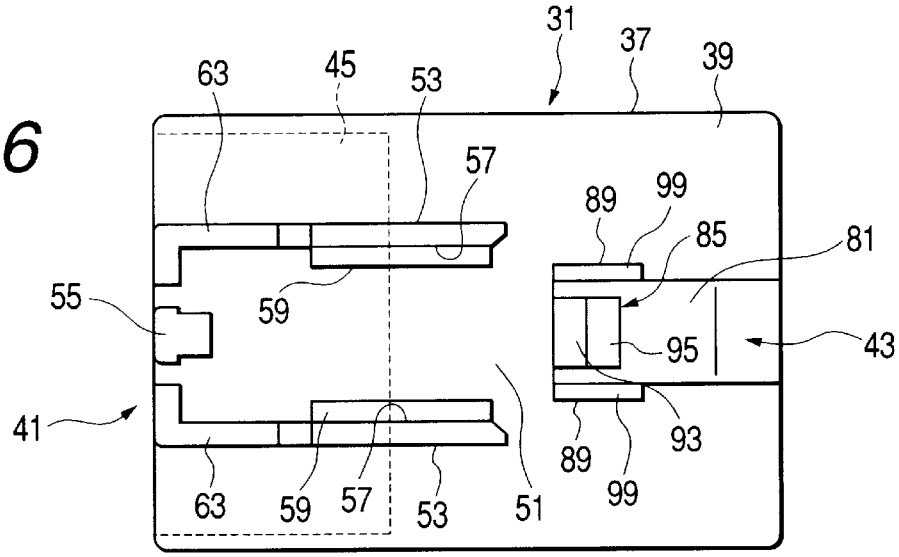
FIG. 6 is a plan view illustrating the male connector shown in FIG. 1.
Figure 7:
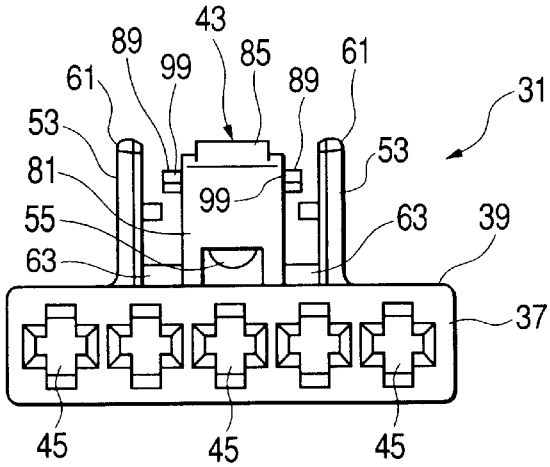
FIG. 7 is a front view illustrating the male connector shown in FIG. 6.
Figure 8:
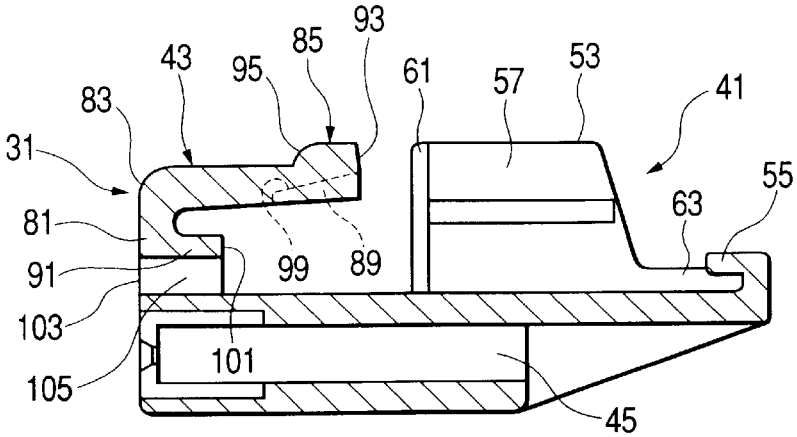
FIG. 8 is a sectional view illustrating the male connector shown in FIG. 7.

FIG. 6 is a plan view illustrating the male connector 31 shown in FIG. 1. FIG. 7 is a front view illustrating the male connector 31 shown in FIG. 6. FIG. 8 is a sectional view illustrating the male connector 31 shown in FIG. 7. As shown in FIGS. 6 to 8, the male connector 31 comprises a male housing body 37, a slider holding portion 41 formed on a side of an upper wall 39 of the male housing body 37, and an elastic latching portion 43 provided on the other side of the upper wall 39 of the male housing body 37 in such a manner as to protrude therefrom. The male housing body 37 has an end portion, in which a terminal accommodating chamber 45 for accommodating terminals is formed, and the other end portion to be inserted into a fitting hood portion 47 of the female connector 33 (to be described later) This male housing body 37 has a slider holding portion 41 for holding a slider 49 (to be described later).

The slider holding portion 41 comprises an outer peripheral surface 51 of the upper wall 39, a pair of sidewalls 53 formed in such a way as to be integral with the upper wall 39, and a supporting projection 55 formed on a side of the male housing body 37. The sidewalls 53 are placed in such a way as to face each other, and each shaped nearly like a rectangle. Each of the sidewalls 53 are formed in such a manner as to extend along the longitudinal direction of the male housing body 37, and as to almost perpendicularly project from the male housing body 37. Each of these sidewalls 53, 53 has a corresponding one of ridge portions 59, 59 respectively formed on the opposite surfaces 57, 57 along the longitudinal direction. Moreover, the space provided between the opposite surfaces 57 is provided in such a manner as to have a dimension that is nearly equal to or slightly larger than a dimension in the direction of width of a slider 49 (to be described later). Each of such sidewalls 53 has a corresponding one of a pressure release portions 61 at an end portion in the longitudinal direction thereof and is connected to a corresponding one of rod-like elements 63 at the other end.

Each of the rod-like elements 63 is L-shaped, and has an end portion formed in such a manner as to be integral with the other end portion of a corresponding one of the sidewalls 53, and also has the other end portion placed at the side of the center in the direction of width of the male housing body 37. A part of each of the rod-like elements 63, 63 at the other side is formed in such a manner as to extend along a side of the male housing body 37. Each of the sidewalls 53, 53 configured in this manner has a corresponding one of the pressure release portions 61 at the other end portion in the longitudinal direction thereof, as described above.

Each of the pressure release portions 61 has a tapered surface, which extends along the direction of height of the sidewalls 53 and is inwardly inclined from a corresponding one of end surfaces 69 to a corresponding one of the opposite surfaces 57, 57. The supporting projection 55 for supporting resilient member 73 (to be described later) is provided in such a slider holding portion 41.

A supporting projection 55 has an L-shaped section and placed between the other end portions of the rod-like elements 63. This supporting projection 55 has one end portion formed in such a manner as to be integral with the upper wall 39 of the male housing body 37, and also has the other end portion placed above the one end portion thereof in such a way as to extend toward the other side of the male housing body 37.

Further, the elastic latching portion 43 is provided at the other side of the male housing body 37. The elastic latching portion 43 comprises an arm portion 81, which has an end part connected to the outer peripheral surface 51 of the male connector 31 in such a manner as to be integral therewith, a bending portion 83 obtained by bending this arm portion 81, a latching projection 85 provided on an outer surface of the arm portion 81 at the other side in such a way as to project therefrom, canceling projections 89 respectively provided on the opposite side surfaces of the arm portion 81, and a stopper portion 91 formed at side of one end part of the arm portion 81.

The arm portion 81 is provided at the other-side edge of the housing body 37 and shaped like a plate having an L-shaped section. This arm portion 81 has one end part formed in such a way as to be integral with the upper wall 39 of the male housing body 37, and also has the other end part placed above the one end part thereof through a bending portion 83 (to be described later) in such a way as to extend toward the one end side of the male housing body 37. The one-side end part of this arm portion 81 is formed in such a manner as to extend in a direction perpendicular to the upper wall 39 of the male housing body 37. The other-side end part of this arm portion 81 is formed in such a manner as to extend along the outer peripheral surface 51 of the upper wall 39.

The bending portion 83 is formed like a plate, which has an arcuate section, in such a manner as to be integral with this arm portion 81 and have elasticity. This bending portion 83 is operative to cause the other-side part of the arm portion 81 to keep a constant posture. A latching projection 85 is provided on an outer surface of the other end part of the arm portion formed in this manner.

The latching projection 85 is provided on the top surface of the other end part of the arm portion 81 in such a manner as to project therefrom. Further, the latching projection 85 has a side end surface 93 on one of sides thereof and also has a tapered surface 95 formed on the other side thereof. Moreover, as described above, the canceling projections 89 are provided on opposite side end surfaces 87 of the arm portion 81 in such a way as to protrude therefrom.

The canceling projections 89 are provided on the other end portion of the arm portion 81 in such a manner as to project from both the side end surfaces 87 thereof in the direction of width thereof. The top surface of each of the canceling projections 89 is a tapered surface 99 gradually upwardly inclined from the front end to the rear end thereof. Further, the elastic latching portion 43 has the stopper portion 91 formed on the one end portion side of the arm portion 81 in such a manner as to be thick.

A through hole 105 extending from the inner surface 101 to the outer surface 103 is formed in the stopper portion 91. The male connector 31 formed in this manner is fitted into the female connector 33.

Figure 9:
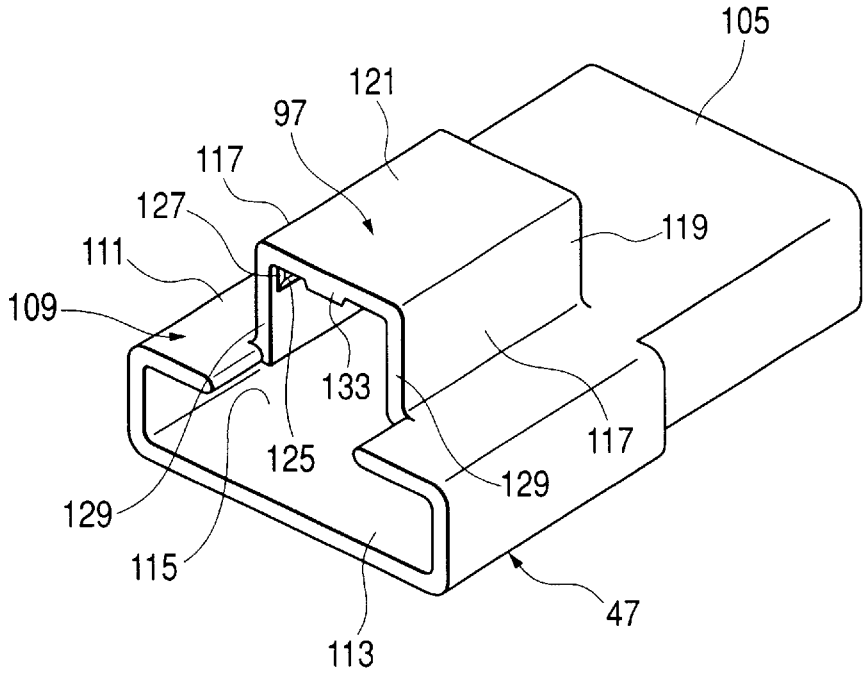
FIG. 9 is a perspective view illustrating the male connector shown in FIG. 1.
Figure 10:
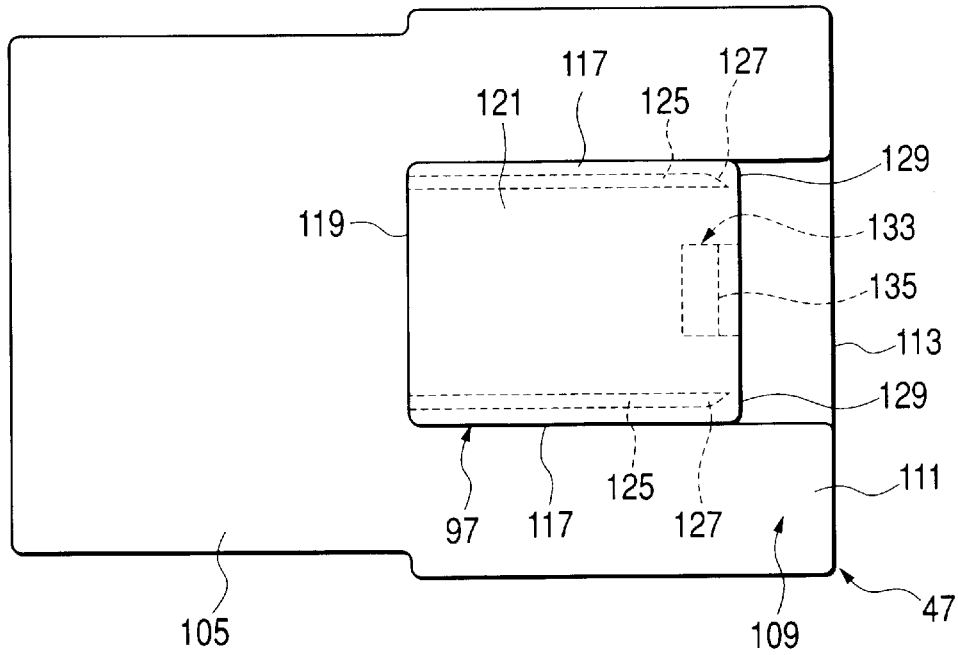
FIG. 10 is a plan view illustrating a female connector shown in FIG. 9.
Figure 11:
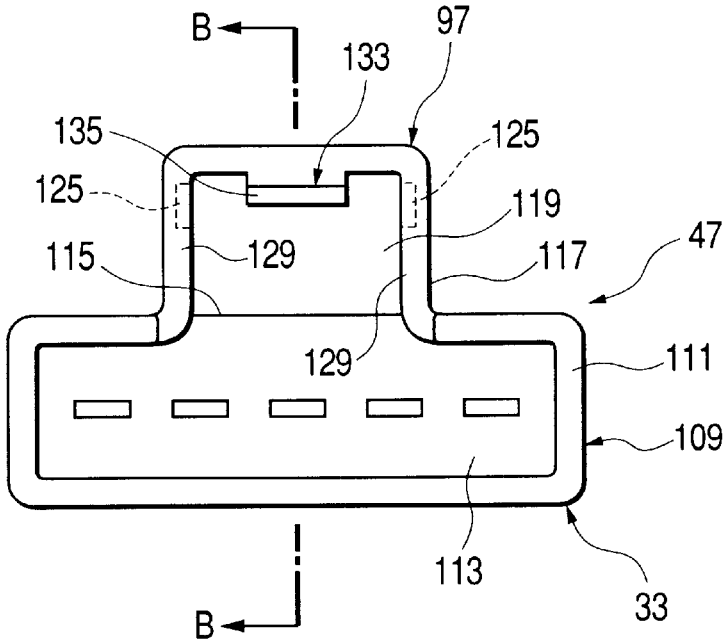
FIG. 11 is a front view illustrating the female connector shown in FIG. 9.
Figure 12:
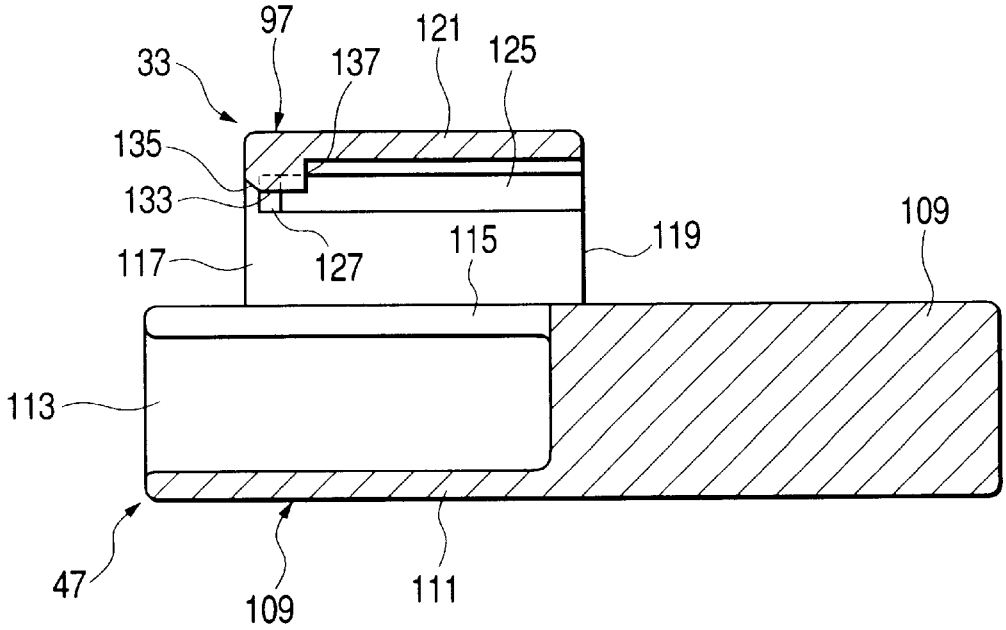
FIG. 12 is a sectional view taken on line B—B of FIG. 10 and illustrates the female connector shown in FIG. 10.

FIG. 9 is a perspective view illustrating the female connector 33 shown in FIG. 1. FIG. 10 is a plan view illustrating the female connector 33 shown in FIG. 9. FIG. 11 is a front view of the female connector 33 shown in FIG. 9. FIG. 12 is a sectional view that is taken on line B—B of FIG. 10 and illustrates the female connector 33 shown in FIG. 10. As shown in FIGS. 1, 9 to 12, the female connector 33 comprises a female housing body 105, and a fitting hood portion 47 formed in this female housing body 105. The female housing body 105 has a terminal accommodating chamber (not shown), which is provided on one side thereof, for accommodating a terminal. Further, the fitting hood portion 47 is integrally formed on the other side of this male housing body 105.

As illustrated in FIG. 9, the fitting hood portion 47 comprises a hood portion 109 and a latching hood portion 97. As shown in FIG. 6, the hood portion 109 has an outer wall 11 and an insertion opening 113 formed in this outer wall 111. The outer wall 111 has a C-shaped section. A rectangular opening 115 is formed in such a way as to extend from the leading end side along the longitudinal direction. The insertion opening 113 is provided in the leading end portion of this outer wall 111.

The insertion opening 113 is formed in such a way as to have a section, whose shape is almost the same as the shape of a section of the male housing body 37. The other side portion of the male connector 31 is inserted into the insertion opening 113, so that the male connector 31 and the female connector 33 are fitted to each other. The latching hood portion 97 is provided in the hood portion 109 of such a configuration.

The latching hood portion 97 has a U-shaped section and formed in such a manner as to project from the outer wall 111 and as to have a concave inside. This latching hood portion 97 comprises side plates 117, which are connected to the out wall 111 and consecutively arranged along the opening edge of the opening 115, and further comprises a rear plate 119 connected to the longitudinal end portion of each of the side plates 117 and a top plate 121 connected to the top end of the side plates 117. Each of the side plates 117 is a rectangular plate, the dimension of which is shorter than the longitudinal dimension of the opening edge. Each of the side plates 117 is erected in a direction nearly perpendicular to the outer wall 111 and placed in such a way as to face the other side plate 117. The side plates 117 are formed so that the dimension of the space provided between the inner surfaces 129 of the side plates 117 is nearly equal to the dimension of the space between the opposite surfaces 57 of the sidewalls 53 of the slider holding portion 41. Groove portions 125 are provided along the longitudinal direction in the inner surface portions 123 of the side plates 117 formed in this manner. Each of the groove portions 125 has a corresponding one of tapered surfaces 127 which is inwardly inclined therefrom a corresponding one of the inner surfaces 123 toward the opening edge side.

An end surface part of one end portion in the longitudinal direction of the side plates 117 is a pushing portion 129 for pushing the slider 49 (to be described later). The rear plate 119 is formed on the other end portion in the longitudinal direction of the side plates 117 in such a way as to be integral therewith. The rear plate 119 is formed like a plate and extends along the direction of width of the opening edge of the opening 115 and connected to the outer wall 111 in a direction nearly orthogonal thereto. As shown in FIG. 1, a hole 131 penetrating through the outer surface and the inner surface is formed.

As described above, the top plate 121 is integrally formed on the top end of the side plates 117. This top plate 121 is formed like a rectangular plate, and has an inner surface placed slightly above the top surface of the arm portion 81 of the elastic latching portion 43 in a state in which the male connector 31 and the female connector 33 are fitted to each other.

Further, a locking projection 133 is provided on the opening edge of the insertion opening 113 in the inner surface part of the top plate 121. As illustrated in FIG. 12, the locking projection 133 has a slope 135 formed on one side of the insertion opening 113, and an engaging surface 137 formed on the other side thereof. When the male connector 31 and the female connector 33 are fitted to each other, this slope 135 slides the tapered surface 95 of the latching projection 85 to thereby downwardly displace the arm portion 81 of the elastic latching portion 43. The engaging surface 137 is engaged with a side end surface 93 of the latching projection 85 in a state in which the male connector 31 and the female connector 33 are fitted to each other.

A half-fitting prevention member 35 for preventing the half-fitted state of the male connector 31 and the female connector 33 is provided in the male connector 31. As illustrated in FIGS. 1 to 5, the half-fitting prevention member 35 comprises a resilient member 73 connected to the male housing body 37, and the slider 49 formed in such a manner as to be laid across this resilient member 73. The half-fitting prevention member 35 is disposed at a height that is nearly equal to the height of the elastic latching portion 43 projecting from the outer peripheral surface 51. The resilient member 73 is constituted by a long helical spring, as shown in FIG. 1. This resilient member 73 is disposed along the longitudinal direction of the upper wall 39 of the male housing body 37. An end portion of the resilient member 73 is supported by inserting the other end par of the supporting projection 55 into the opening. The other end portion of the resilient member 73 abuts against the slider 49.

Figure 13:
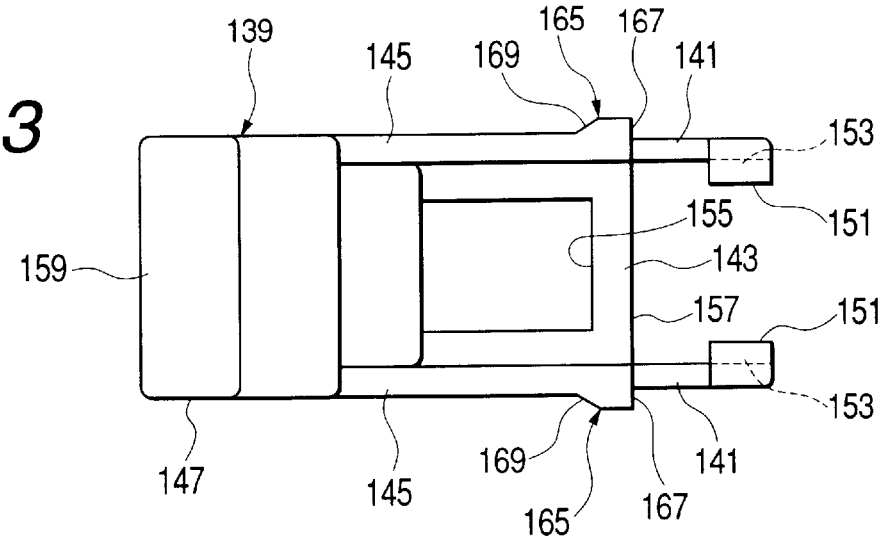
FIG. 13 is a plan view illustrating a slider shown in FIG. 1.
Figure 14:
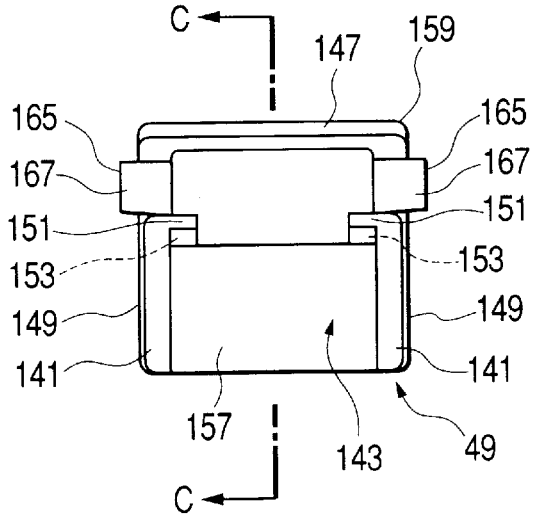
FIG. 14 is a front view illustrating the slider shown in FIG. 13.
Figure 15:
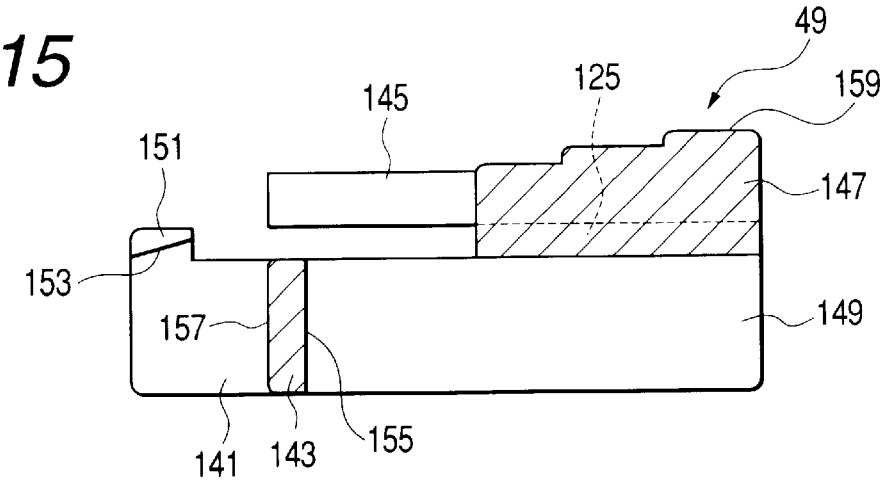
FIG. 15 is a sectional view taken on line C—C of FIG. 14 and illustrates the slider shown in FIG. 14.

FIG. 13 is a plan view of the slider shown in FIG. 1. FIG. 14 is a front view of the slider shown in FIG. 13. FIG. 15 is a sectional view that is taken on line C—C of FIG. 14 and that illustrates the slider shown in FIG. 14. The slider 49 comprises a slider body 139, slider arms 141 provided in the slider body 139, an abutting portion 143 formed in such a manner as to be integral with the slider arms 141, flexible arms 145, and an operation portion 147 formed at a rear end of the slider body 139. The slider 49 is disposed between the sidewalls 53 of the slider holding portion 41.

The slider body 49 comprises a pair of plate-like elements 149 disposed in such a manner as to face each other, as shown in FIGS. 14 and 15. These plate-like elements 149 are placed on opposite sides of the resilient member 73, as shown in FIGS. 4 and 5. The dimension of the space between the inner surfaces of the plate-like elements 149 is set at a value that is nearly equal to or slightly larger than the diameter of the resilient member 73. The slider arms 141 are formed at an end portion in the longitudinal direction of this slider body 139.

The slider arms 141 are each shaped like a rectangular plate, as shown in FIGS. 13 to 15. Further, the slider arms 141 are formed in such a manner as to be integral with parts of the slider body 139 in a state in which these parts of the body 139 is extended in the longitudinal direction thereof. These slider arms 141 are disposed on the sides of the elastic latching portion 43. The slider projections 151 are provided at the inner side of an upper part of the leading ends of the slider arms 141 respectively.

The slider projections 151 are formed so that the bottom surfaces thereof are slopes 153 each of which is upwardly inclined in a direction from the front side to the rear side. These slider projections 151 slide on the tapered surfaces 99 of the canceling projections 89 of the elastic latching portion 43 when the slider 49 is moved against the pushing force of the resilient member 73 of the connectors 31 and 33 in the slider holding portion 41. The slider arms 141 are connected to each other through the abutting portion 143 formed in such a manner as to be integral with each thereof.

The abutting portion 143 is shaped like a plate, and connected to a middle portion in the longitudinal direction of each of the slider arms 141. This abutting portion 143 has an inner surface 155, against which the other end of the resilient member 73 abuts, and also has an outer surface 157 that is caused by the pushing force of the resilient member 73 to abut against a stopper portion 91 of the elastic latching portion 43. Thus, the slider 49 is supported on the outer peripheral surface of the resilient member 73 in such a manner as to be able to be moved in the slider holding portion 41 by the resilient member 73. The operation portion 147 is formed in such a slider 49.

The operation portion 147 is formed by being terraced so that the height of the top surface 159 thereof above the outer peripheral surface 51 of the upper wall 39 gradually increases in the direction from one end to the other end in the longitudinal direction thereof. This operation portion 147 is put into a state in which opposite sides in the direction of width of this operation portion 147 are connected to the top end of the slider body 139, and in which the resilient member 73 is disposed between the inner surface 165 and the outer peripheral surface 51 of the upper wall 51.

Further, the other end of the top surface 159 of the operation portion 147 is the highest part of the slider 49 that projects from the outer peripheral surface of the slider 49. As illustrated in FIG. 5, the operation portion 147 is formed so that the height of the other end of the top surface 159 of the operation portion 147 above the outer peripheral surface 51 is nearly equal to the height of the top surface 161 of the latching projection 85 of the elastic latching portion 43. The operation portion 147 formed in this manner is pushed and operated when the slider 49 is moved against the pushing force of the elastic portions 125 are formed in a lower part of a side surface portion along the longitudinal direction in the operation portion 147. These groove portions 125 engage with the ridge portions 59 of the sidewalls 53, respectively, so that the slider 49 is held by the slider holding portion 41.

As illustrated in FIGS. 13 to 15, a pair of flexible arms 145 integrally formed in the operation portion 147 is shaped like a rod, and provided on opposite sides of one end in the longitudinal direction of the operation portion 147. These flexible arms 145 are provided in the operation portion 147 in such a way as to project therefrom toward the other end of the male housing body 37, and formed in such a manner as to extend in parallel with each other along the longitudinal direction of the male housing body 37. Furthermore, the leading ends of the flexible arms 145 are disposed to the side of the slider body 139 from the ends of the slider arms 141. Moreover, engaging projections 165 are formed at the leading ends of the flexible arms 145 in such a manner as to project from the outer surface.

The engaging projections 165 are formed in such a way as to slightly protrude with respect to the outer surface of the slider body 139. An end surface of each of the engaging projections 165 is an abutting surface 167 to be pushed by the pushing portion 129. Each of the engaging projections 165 has a slope 169 formed in the outer side thereof.

As illustrated in FIGS. 16 to 21, the male connector 31 and the female connector 33, which are configured in this manner, are fitted and connected to each other. For the fitting and connecting of the male connector 31 and the female connector 33, a section of the leading end of the male connector 31 is matched in shape with a section of the fitting hood portion 47 of the female connector 33. Thereafter, the end of the male connector 31 is inserted into the fitting hood portion 47. In this state, the male connector 31 is inserted to a regular insertion position in the fitting hood portion 47. Thus, the connectors 31 and 33 are brought into a fitted state. At that time, the fitted state of the connectors 31 and 33 is retained by the elastic latching portion 43.

Figure 16:
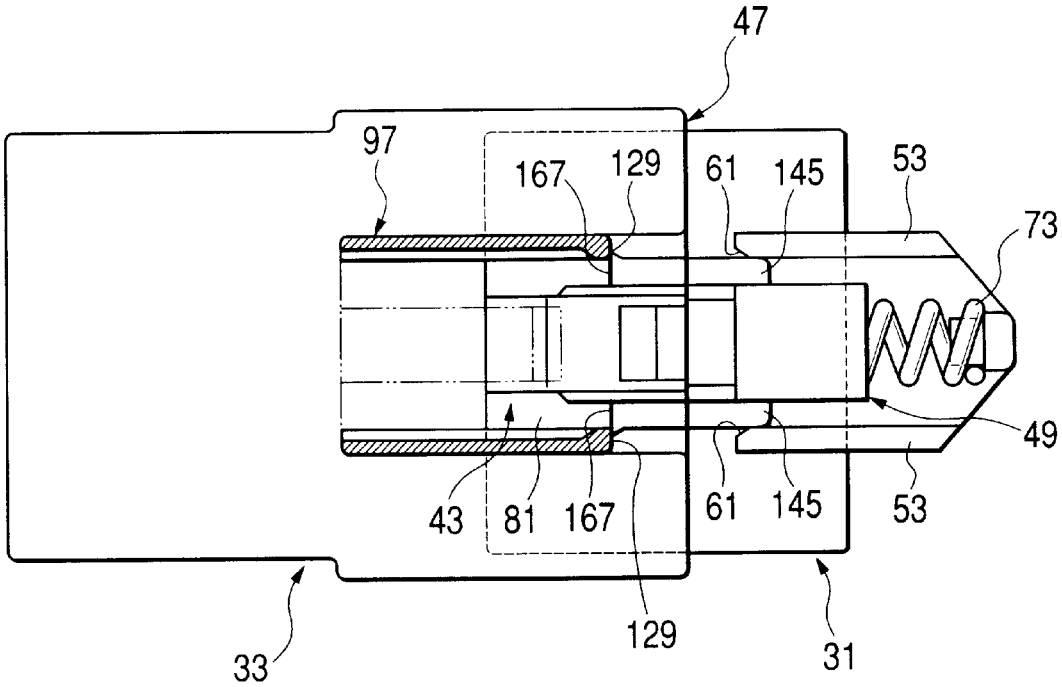
FIG. 16 is a plan view illustrating the connector in a state in which the male connector shown in FIG. 1 is inserted into the female connector.
Figure 17:
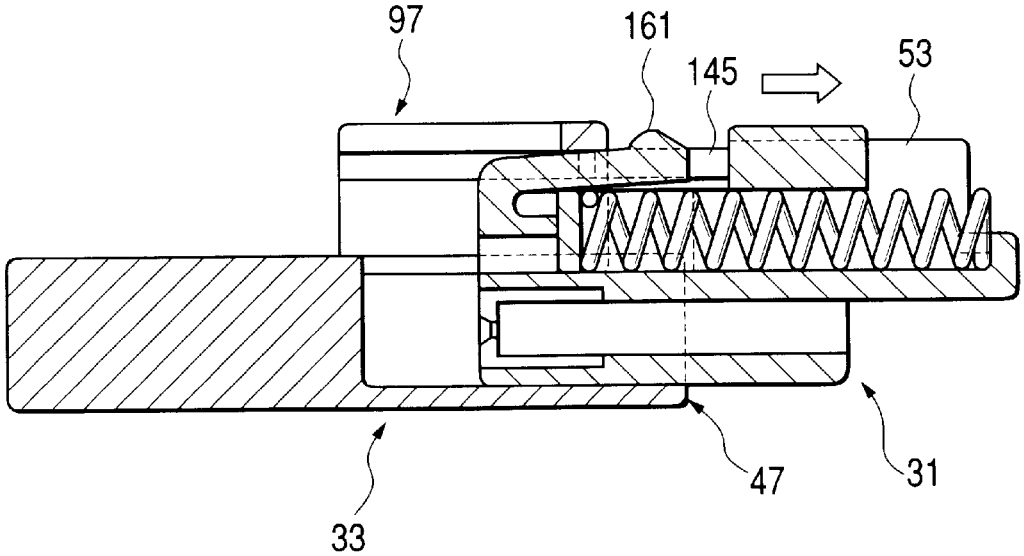
FIG. 17 is a sectional view illustrating the connector shown in FIG. 16.

As described above, when the male connector 31 is fitted to the female connector 33, the other side of male connector 31 is inserted into the fitting hood portion 47 of the female connector 33, as illustrated in FIGS. 16 and 17. At that time, the pushing portions 129 abut against the abutting surfaces 167 of the engaging projections 165 of the flexible arms 145, respectively. The fitting hood portion 97 accommodates the one end part of the arm portion 81 of each of the elastic latching portions 43 therein. When the male connector 31 is inserted into the fitting hood portion 47 still more in this state, the abutting surfaces 167 are pushed by the pushing portions 129. Further, the slider 49 is moved in a fitting direction against the pushing force of the resilient member 73.

At that time, in the elastic latching portion 43, the slope 135 of the locking projection 133 of the latching hood portion 97 abuts against the tapered surface 95 of the latching projection 85 thereof. In this state, the tapered surfacce 95 slides on the slope 135. Further, the tapered surface 95 is pushed by the locking projection 133. Thus, in the elastic latching portion 43, the bending portion 83 is bent. Then, the arm potions 81 are downwardly displaced with respect to the locking projections 133.

Figure 18:
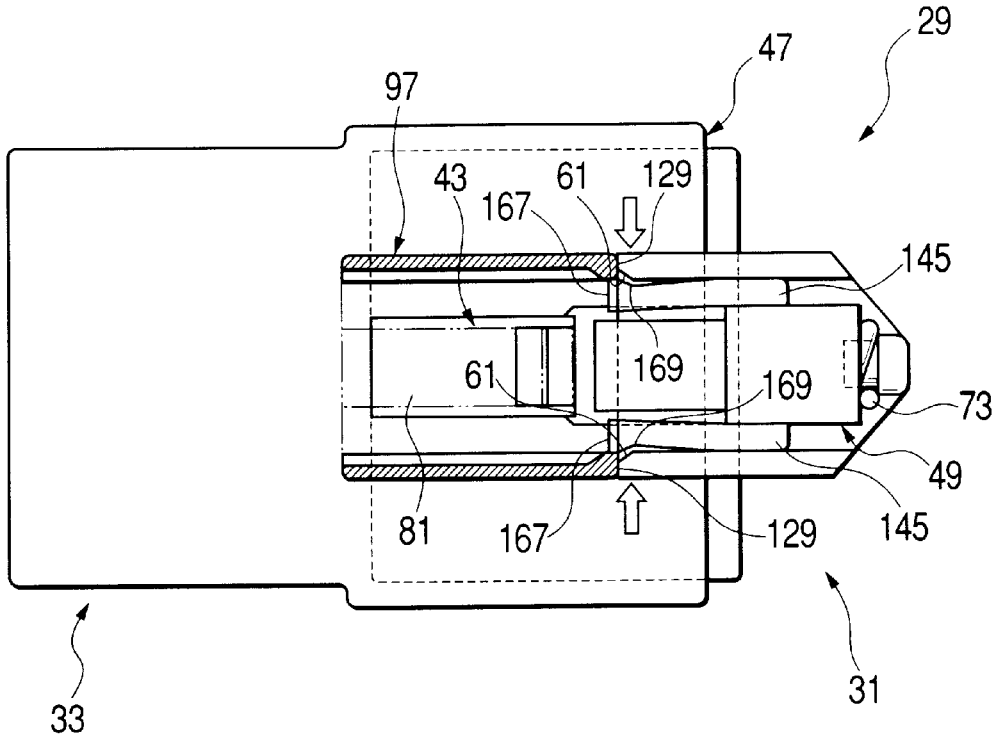
FIG. 18 is a plan view illustrating the connector in a stat in which the male connector shown in FIG. 1 is inserted to a regular insertion position in the female connector.
Figure 19:
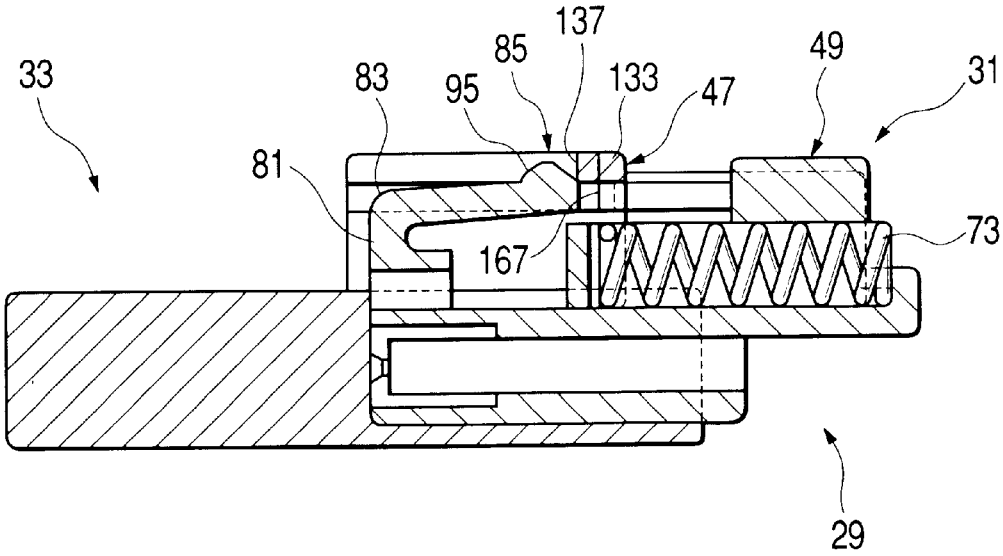
FIG. 19 is a sectional view illustrating the connector shown in FIG. 18.

Thereafter, when the male connector 31 is inserted to the regular insertion position in the female connector 33, the pushing portions 129 of the latching hood portion 97 abut against the end surfaces of the sidewalls 53 of the slider holding portion 41, as illustrated in FIGS. 18 and 19. At that time, the slopes 169 of the engaging projections 165 abut against the pressure release portions 61 of the sidewalls 53 of the slider holding portion 41. In this state, the slopes 169 cause the pressure release portions 61 to slide thereon. The slopes 169 are pushed by the pressure release portions 61. Thus, the leading ends of the flexible arms 145 are turned by using the operation portion 147 as a fulcrum, so that the flexible arms 145 are displaced inwardly with respect to the sidewalls 53. In this way, the pushed state caused by the pushing portions 129 of the engaging projections 165 is canceled.

Figure 20:
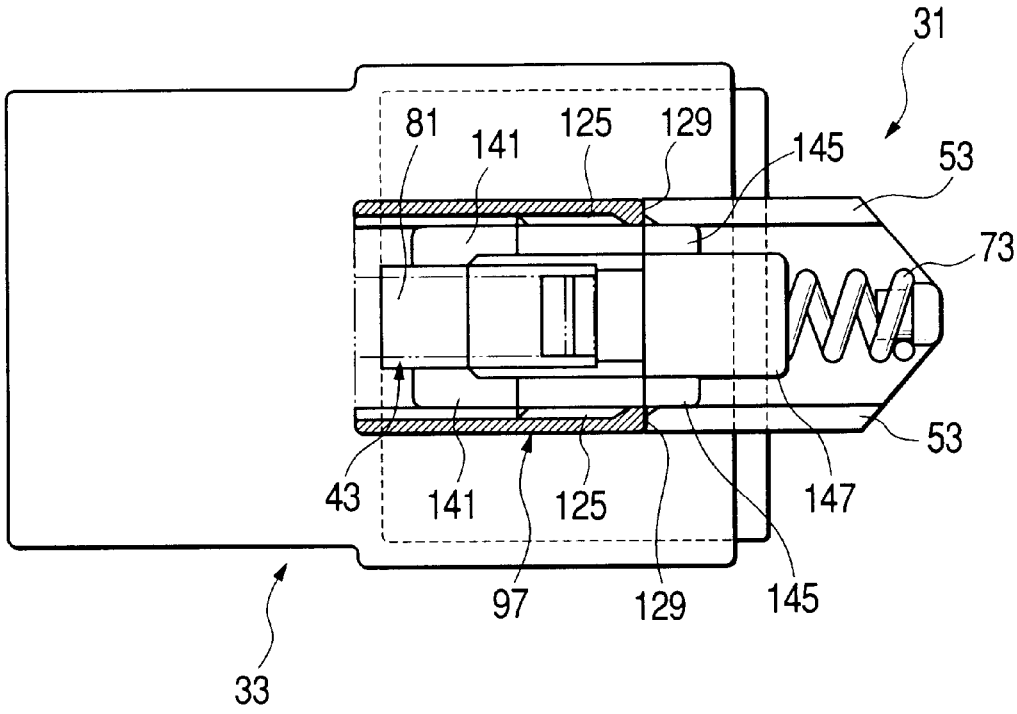
FIG. 20 is a plan view illustrating the connector in a state in which the male and female connectors shown in FIG. 1 are fitted to each other.
Figure 21:
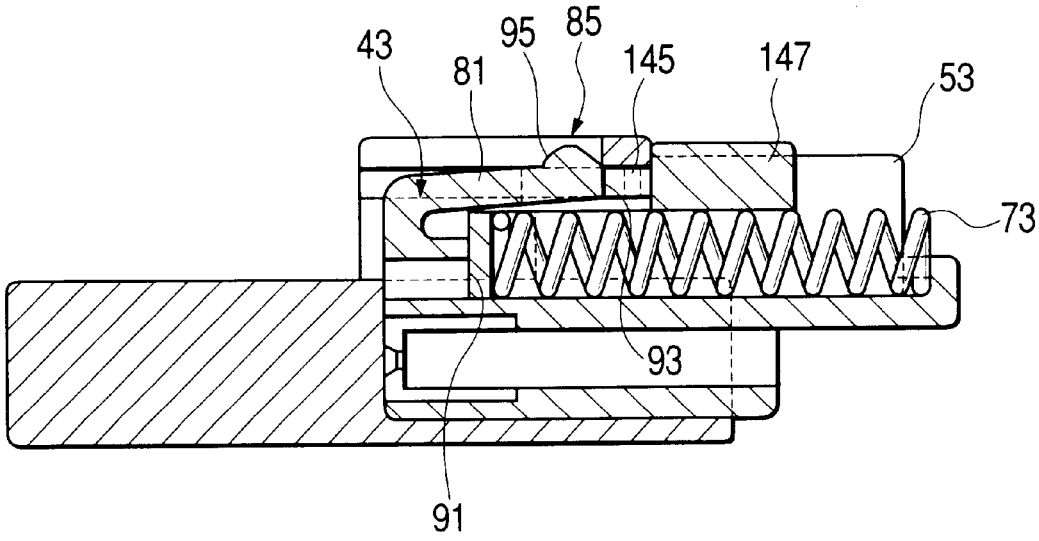
FIG. 21 is a sectional view illustrating the connector shown in FIG. 20.

Then, the slider 49 is moved to an initial supporting position by the pushing force of the resilient member 73, as illustrated in FIGS. 20 and 21. At that time, the end parts of the side surfaces 53 abut against the pushing portions 129 of the latching hood portion 97. The opposite surfaces 57 of the sidewalls 53 are flush with the inner surfaces of the latching hood portions 97, respectively. Thus, the slider 49 can easily move to the initial supporting position. Further, when the slider 49 moves to the initial supporting position, the flexible arms 145 are accommodated in the latching hood portion 97. Then, the engaging projections 165 of the flexible arms 145 are engage with the groove portions 125 of the latching hood portion 97.

Furthermore, when the male connector 31 is inserted to the regular insertion position in the female connector 33, in the elastic latching portion 43, the latching projection 85 gets over the locking projection 133, as illustrated in FIGS. 18 to 21. The side end surface 93 of the latching projection 85 engages with the engaging surface 137 of the locking projection 133. Thus, the fitted state of the male connector 31 and the female connector 33 is retained. At that time, the entire elastic latching portion 43 is accommodated in the latching hood portion 97.

Incidentally, in a half-fitted state in which the male connector 31 is no inserted to the regular insertion position in the female connector 33, the slider 49 is pushed by the pushing portions 129 against the pushing force of the resilient member 73, though this is not illustrated in the drawings. Thus, the pushing force of the resilient member 73 causes the slider 49 to push the pushing portions 129 of the latching hood portion 97. Consequently, the half-fitted state of the connectors 31 and 33 is notified by detaching the male connector 31 from the female connector 33. Consequently, the half-fitted state of the connectors can be reliably prevented.

Further, in the case that the slider 49 is preliminarily moved against the pushing force of the resilient member 73 and that then the male connector 31 is inserted into the female connector 33, the slider 49 is put into a state in which the member 73 is displaced by performing a pushing operation. In this state, the male connector 31 is inserted to the regular insertion position of the female connector 33. Then, the operation of pushing the slider 49 is canceled. Thus, the connectors 31 and 33 can be put into a fitted state.

Figure 22:
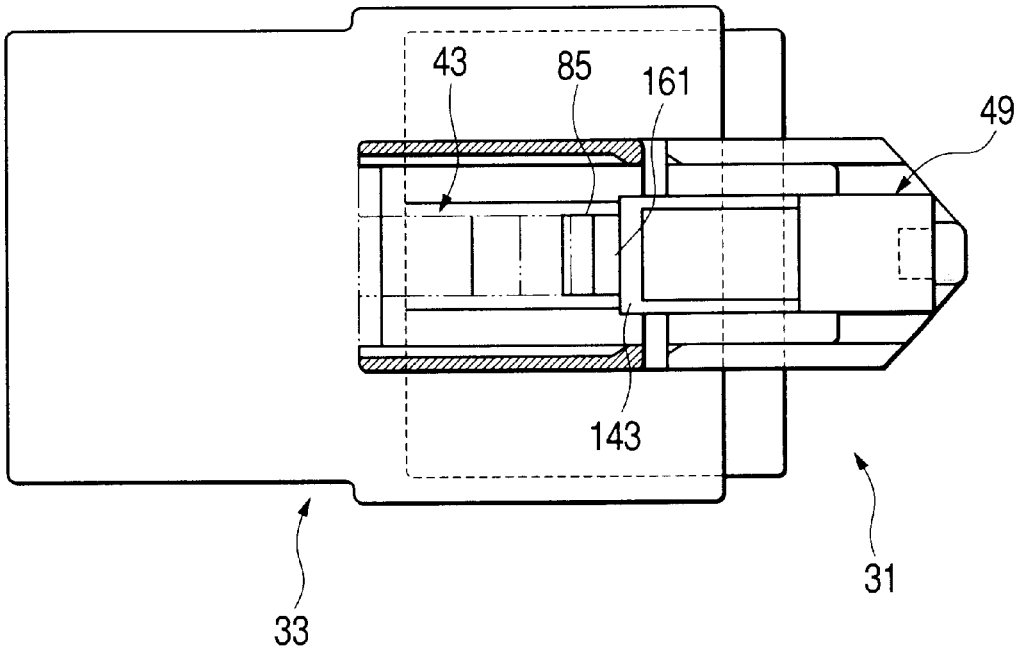
FIG. 22 is a sectional view illustrating the connector at the time of canceling the fitted state of the male and female connectors shown in FIG. 1.
Figure 23:
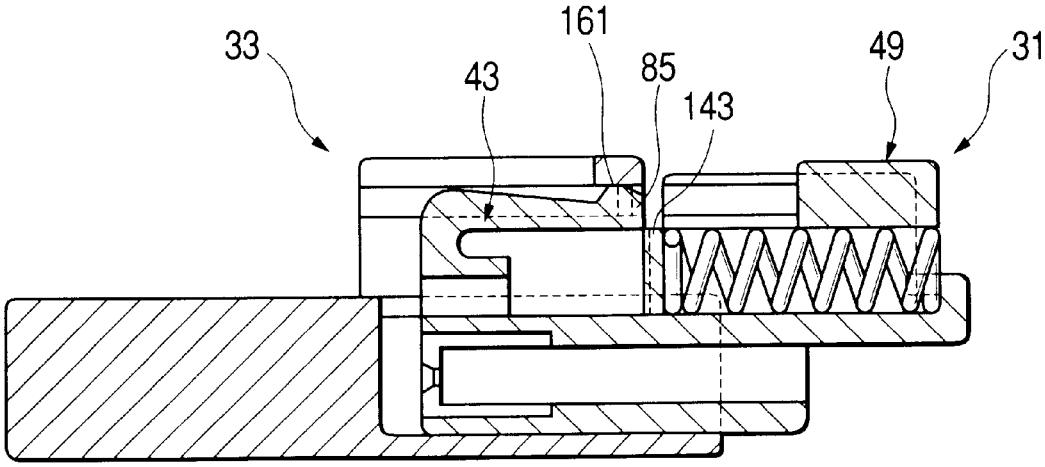
FIG. 23 is a sectional view illustrating the connector shown in FIG. 22.
Figure 24:
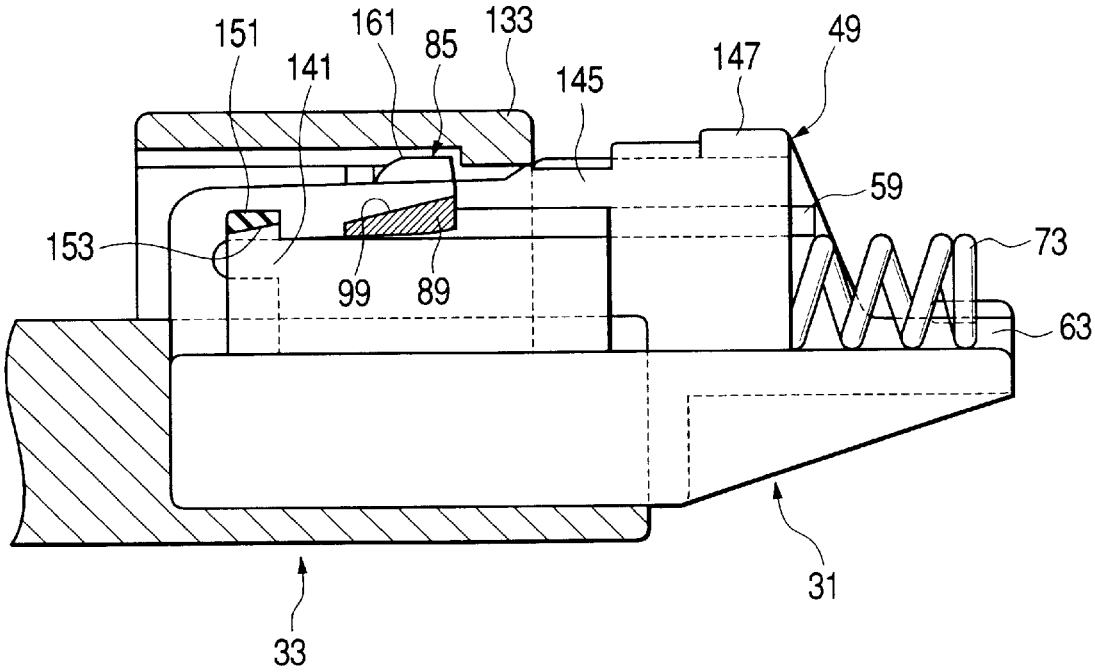
FIG. 24 is an enlarged sectional view illustrating a primary part of the connector shown in FIG. 20.
Figure 25:
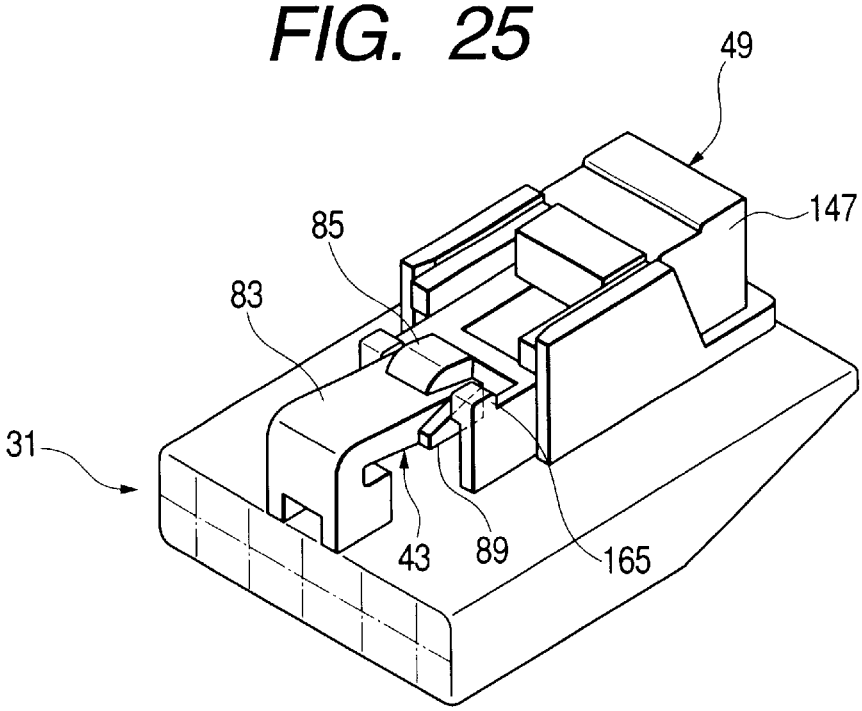
FIG. 25 is a perspective view illustrating the male connector of the connector shown in FIG. 22.
Figure 26:
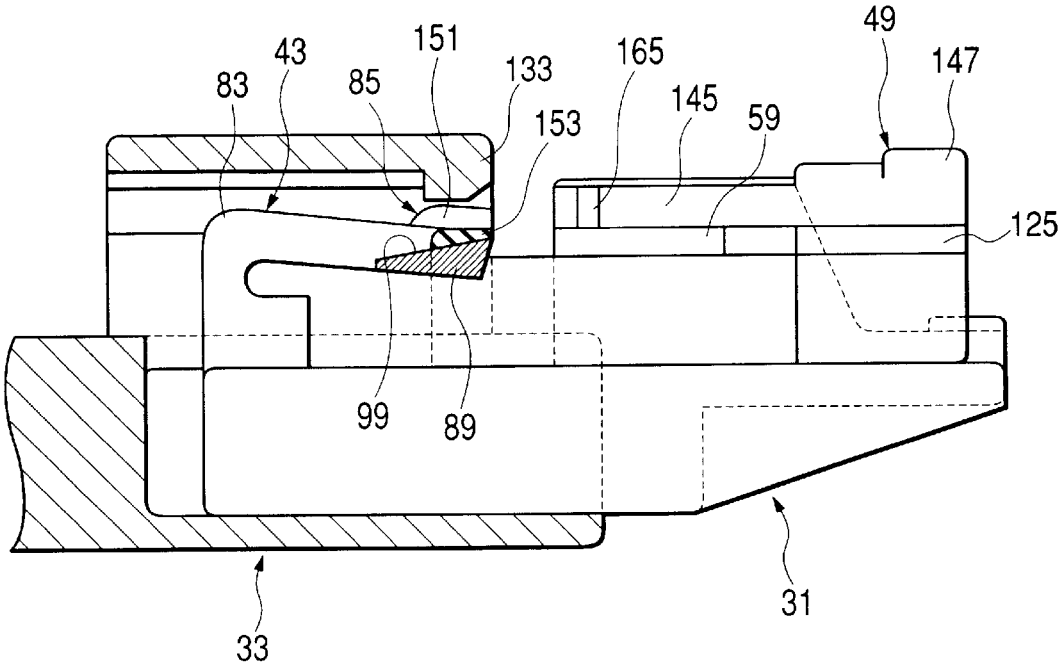
FIG. 26 is an enlarged sectional view illustrating the primary part of the connector shown in FIG. 22.
Figure 27:
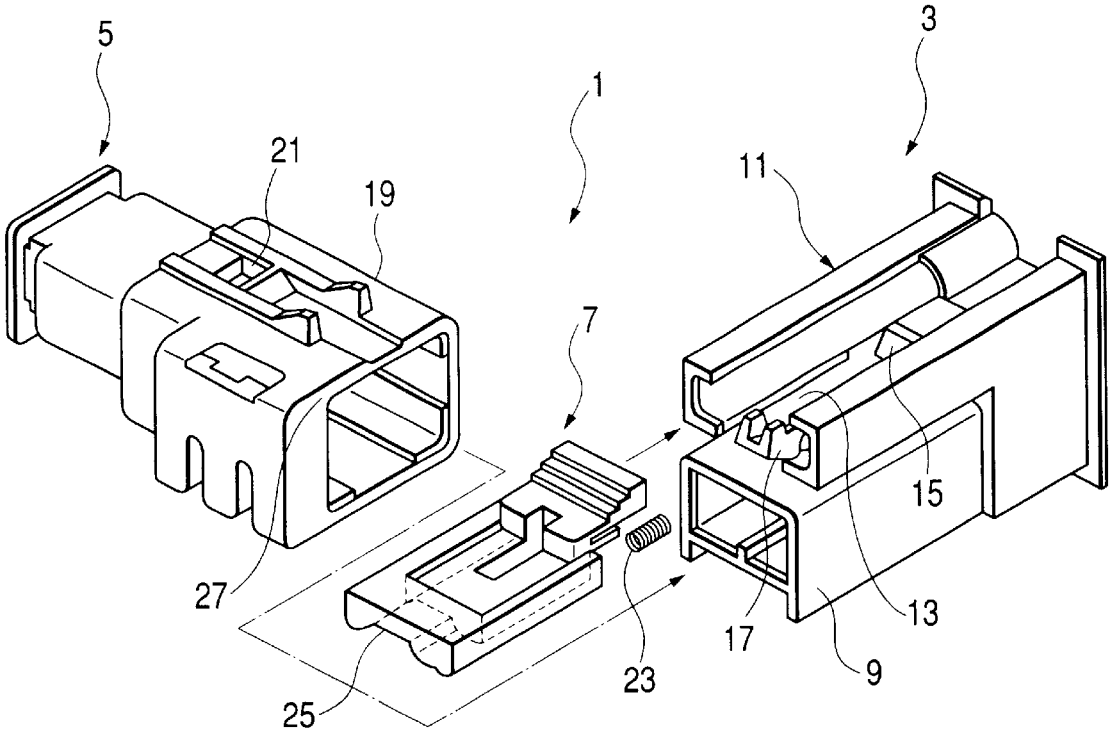
FIG. 27 is an exploded perspective view illustrating a related connector.

In this case, when the connectors 31 and 33 are in the half-fitted state, the top surface 161 of the latching projection 85 of the elastic latching portion 43 abuts against the bottom surface of the locking projection 133, as illustrated in FIGS. 22 and 23. When the operation of pushing the slider 49 is canceled in this state, the abutting portion 143 of the slider 49 abuts against the end surface of the arm portion 81. Thus, the slider 49 cannot return to the initial position. Consequently, the half-fitted state of the connectors 31 and 33 is notified according to the position of the slider 49. Therefore, the half-fitting state can be reliably prevented from being retained.

Additionally, when the fitted state of the connectors 31 and 33 is canceled, the operation portion 147 is pushed to thereby move the slider 49 against the pushing force of the resilient member 73, as illustrated in FIGS. 22 to 26. Thus, the fitted state thereof is canceled.

As described above, when the slider 49 is moved against the pushing force of the resilient member 73 by pushing the operation portion 147, the slopes 153 of the slider projections 151 abut against the tapered surfaces 99 of the canceling projections 89. Then, the slider 49 is moved still more in a fitting canceling direction, the slopes 153 slide on the tapered surfaces 99. Moreover, the tapered surfaces 99 are pushed by sides of the slopes 153. Thus, in the elastic latching portion 43, the bending portion 83 is bent. Then, the arm portion 81 is downwardly displaced with respect to the latching hood portion 97. Consequently, the latching projection 85 falls down. At that time, the slope 169 of each of the engaging projections 165 abuts against the corresponding tapered surface 127 of the groove portion 125.

Thereafter, the slider 49 is moved against the pushing force of the resilient member 73, so that the end surface thereof is caused to abut against the side surfaces of the rod-like elements 63 of the slider holding portion 41. At that time, the latching projection 85 of the elastic latching portion 43 falls down still more. Consequently, the engagement between the latching projection 85 and the locking projection 133 is canceled.

Further, the slopes 169 of the engaging projections 165 slide on the tapered surface 127 of the groove portions 125. Thus, the slopes 169 are pushed by the tapered surfaces 127, so that the flexible arms 145 are inwardly displaced. In this state, the slider 49 is moved in the fitting canceling direction, so that the connectors 31 and 33 are put into a half-fitted state. Thus, the operation of pushing the operation portion 147 is canceled. Consequently, the slider 49 pushes the pushing portion 129 to thereby detach the male connector 31 from the female connector 33. Thus, the fitted state of the connectors 31 and 33 can be canceled.

As described above, the connector 29 according to this embodiment can retain the fitted state of the connectors 31 and 33 by causing the latching projection 85 of the elastic latching portion 43 to catch the locking projection 133 of the latching hood portion 97. Thus, there is no necessity for preventing the arm portions 81 of the elastic latching portion 43 from being accidentally displaced by the slider 49, which would occur in the related connector. Consequently, according to this embodiment, flexibility in determining the mounting position of the slider 49 is enhanced.

Thus, the top surface 161 of the latching projection 85 is enabled to have a height, which is nearly equal to that of the top surface 159 of the operation portion 147, without increasing the dimensions in the direction of width and height of one of the male connector 31 by placing the slider 49 between the top surface 161 of the latching projection 85 of the arm portion 81 of the elastic latching portion 43.

Therefore, according to the connector 29 of this embodiment, the miniaturization of the connector is achieved. Moreover, the fitted state of the male connector 31 and the female connector 33 can be retained.

Further, in the fitted state of the connectors 31 and 33, the entire elastic latching portion 43 is accommodated by the latching hood portion 97. Thus, no external force is accidentally exerted on the elastic latching portion 43. Therefore, the elastic latching portion 43 having been in the state, in which this latching portion is caught in the latching hood portion 97, does not bend. Consequently, the fitted state of the connectors 31 and 33 can be reliably retained.

Further, in the case of this connector 29, when the slider 49 is moved against the pushing force of the resilient member 73 in the fitted state of the connectors 31 and 33, the slider projection 151 of the slider 49 slidably touches the canceling projections 89, 89 of the elastic latching portion 43. Thus, the bending portion 83 is bent, so that the engagement between the latching projection 85 of the elastic latching portion 43 and the locking projection 133 of the latching hood portion 97 can be canceled.

Therefore, the retainment of the fitted state of the male connector 31 and the female connector 33 can be canceled only by moving the slider 49 against the pushing force of the resilient member 73. Thus, when the operation of pushing the operation portion 147 of the slider 49 is canceled by putting the connectors 31 and 33 into a half-fitted state, the slider 49 can detach the male connector 31 from the female connector 33 by the pushing force of the resilient member 73. This facilitates a fitting canceling operation.

Furthermore, in the fitted-state of the connectors 31 and 33, the engaging projection 165 of the slider 49 can be engaged with the groove portion 125 of the latching hood portion 97. Thus, the retainment of the fitted state of the connectors 31 and 33 can be more reliably achieved.

Additionally, the fitted state of the male connector 31 and the female connector 33 is retained by engaging the elastic latching portion 43 with the latching hood portion 97. Thus, even when the male connector 31 has no half-fitting prevention member 35, the fitted state thereof can be retained by engaging the elastic latching portion 43 with the latching hood portion of the female connector 33. Consequently, the connector of the invention can be used for general purpose.

What is claimed is:

1. A connector comprising:

a first connector having an elastic latching member and a pressure release portion projected therefrom;

a second connector fitted to the first connector having a latching hood portion projected therefrom and a locking projection engaged with the elastic latching member for retaining the first and second connectors in a fitted state, wherein the elastic latching member is displaced by the locking projection in a first direction for getting over the locking projection when the first and second connectors are brought into the fitted state; and a half-fitting prevention member for detaching the first connector from the second connector when the first and second connectors are half-fitted to each other in a half fitted state having a flexible arm, wherein the half-fitting prevention member is placed nearer than the elastic latching member with respect to the first connector when the first and second connector are in the fitted state, wherein the flexible arm abuts against the latching hood portion when the first and second connectors are in the half-fitted state, the pressing release portion pushes the flexible arm in a direction substantially perpendicular to the first direction for canceling the abutting state of the flexible arm and the latching hood portion when the first and second connectors are brought into the fitted state.

2. The connector according to claim 1, wherein the second connector includes a fitting hood accommodating the first connector and the fitting hood portion accommodating the entirety of the elastic latching member in the fitted slate.

3. The connector according to claim 1, wherein the half-fitting prevention member includes, the flexible arm, a resilient member connected to the first connector, and the slider which is movable in a fitting direction substantially perpendicular to the first direction and the second direction and is pushed against a pushing force of the resilient member by the second connector through the abutting state of the flexible arm and the latching hood portion in the half-fitted state.

4. The connector according to claim 3, wherein a base portion of the elastic latching member is projected from an outer peripheral surface of the first connector, a middle portion of the elastic latching member is bent, the distal end portion of the elastic latching member is extended along the outer periphery of the first connector and includes a bent latching projection, the resilient member is extended along the outer periphery of the first connector, the slider is laid across the resilient member and provided with an operation portion to be operated when the fitted state of said male and female connectors is canceled, wherein the operation portion is formed so that a height of an end surface of the latching projection above the outer peripheral surface is almost equal to a height of an end surface of the operation portion thereabove.

5. The connector according to claim 3 further comprising:

a retainment canceling portion for canceling retainment of the fitted state, which is performed by the elastic latching portion, when the slider in the fitted state of the male and female connectors is moved against the pushing force of the resilient member.

6. The connector according to claim 5, wherein the retainment canceling portion includes a retainment canceling projection projected from a side end surface of the elastic latching portion, a slider arm provided in the slider and disposed on a side of said elastic latching portion in the fitted state, and a slider projection provided on the slider arm in such a way as to protrude therefrom and abutting against the elastic latching portion and bends the elastic latching portion when the slider is moved against the pushing force of the resilient member in the fitted state.

7. The connector according to claim 3, wherein an engaging mechanism for engaging the latching hood portion with the slider in the fitted state is provided on the second housing and the half-fitting prevention member.

* * * * *